US007118110B2

(12) United States Patent
Kowalczyk

(10) Patent No.: US 7,118,110 B2
(45) Date of Patent: Oct. 10, 2006

(54) METHOD AND APPARATUS FOR ORTHOGRAPHY BOARD GAME

(76) Inventor: Patrick Michael Kowalczyk, 4660 Burkshire La., Waterloo, IL (US) 62298

( * ) Notice: Subject to any disclaimer, the term of this patent is extended or adjusted under 35 U.S.C. 154(b) by 275 days.

(21) Appl. No.: 10/785,824

(22) Filed: Feb. 24, 2004

(65) Prior Publication Data

US 2005/0077681 A1 Apr. 14, 2005

Related U.S. Application Data

(60) Provisional application No. 60/450,151, filed on Feb. 26, 2003.

(51) Int. Cl.
*A63F 3/00* (2006.01)

(52) U.S. Cl. ..... 273/272; 273/236

(58) Field of Classification Search ..... 273/272, 273/236, 299

See application file for complete search history.

(56) References Cited

U.S. PATENT DOCUMENTS 4,190,255 A 2/1980 Hughes
4,384,722 A * 5/1983 Higgins ..... 273/272
4,741,538 A 5/1988 Lewis
5,269,530 A 12/1993 Miller
5,429,371 A 7/1995 Bledsoe
6,367,798 B1 * 4/2002 Lawal ..... 273/272
6,769,692 B1 * 8/2004 Cavalluzzo ..... 273/272
2004/0051246 A1 * 3/2004 Dunn ..... 273/272

* cited by examiner

*Primary Examiner*—Vishu K. Mendiratta
(74) *Attorney, Agent, or Firm*—Polster, Lieder, Woodruff & Lucchesi, L.C.

(57) ABSTRACT

Briefly stated, the present invention is an orthography board game having an apiarian theme. The game consists of a game board having a plurality of hexagonal playing spaces arranged in an overall hexagonal pattern. Selected playing spaces on the board are assigned predetermined characteristics which alter the play of the game, creating bonus locations and penalty locations. A plurality of hexagonally shaped game tiles are provided, each game tile sized to fit within a playing space on the game board and assigned a letter or symbol having a predetermined distribution with the complete set of game tiles. A plurality of six-sided game cubes or dice are provided, together with a rolling cup, and are utilized to determine a players score during each round of game play.

12 Claims, 4 Drawing Sheets

METHOD AND APPARATUS FOR ORTHOGRAPHY BOARD GAME

CROSS-REFERENCE TO RELATED APPLICATIONS

The present application is related to, and claims priority from, U.S. Provisional Patent Application Ser. No. 60/450,151 filed on Feb. 26, 2003.

STATEMENT REGARDING FEDERALLY SPONSORED RESEARCH

Not Applicable.

BACKGROUND OF THE INVENTION

The present invention relates generally to a word-based board game and method of play, and in particular, to a word-based board game apparatus and method of play for multiple players wherein an object of play is accumulation of points via the placement of letter tiles on a hexagonal playing board and the rolling of a scoring dice.

In traditional word-based board games, such as the well known game Scrabble™ the object of play is to accumulate points by placing letter tiles on a game board to form words. Each letter tile placed on the board is assigned a value based in part on the letter on the tile, and in part upon the location on the game board. The total of all letter tiles utilized during a players turn is added, to achieve a total score for that turn of play. Additional bonus points are awarded for placing letter tiles on specific locations distributed about the game board. This style of game rewards players having an extensive vocabulary, and who are capable of placing a limited set of letters onto the game board in a manner which maximizes available points. As such, games such as Scrabble™ are difficult to play with multiple players having either different skill levels or different vocabularies, i.e. with a combination of adults and children.

Accordingly, it would be advantageous to provide a method and an apparatus for play of a word-based board game in which game play among adults and children is independent of a player's skill and vocabulary, and which is equally entertaining for players of all ages, while simultaneously serving as a learning or teaching aid for younger players.

BRIEF SUMMARY OF THE INVENTION

Briefly stated, the present invention is an orthography board game having an apiarian theme. The game consists of a game board having a plurality of hexagonal playing spaces arranged in an overall hexagonal pattern. Selected playing spaces on the board are assigned predetermined characteristics which alter the play of the game, creating bonus locations and penalty locations. A plurality of hexagonally shaped game tiles are provided, each game tile sized to fit within a playing space on the game board and assigned a letter or symbol having a predetermined distribution with the complete set of game tiles. A plurality of six-sided game cubes or dice are provided, together with a rolling cup.

A preferred method of playing an orthography board game of the present invention consists of players sequentially placing combinations of game tiles on a playing board to spell words. After a player has successfully formed a word on the playing board, a plurality of game cubes or dice are rolled to determine a base score. The base score is modified in a predetermined manner based upon the locations on the game board on which the player has placed the combination of game tiles to spell the word. The resulting modified score is tallied, and game play continues with the next player in sequence. At the end of the game play, when all game tiles have been utilized, the player with the highest score tally is declared the winner.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
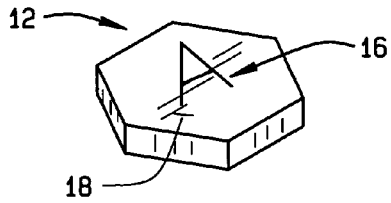
FIG. 1 is a perspective view of a hexagonal letter tile of the present invention.

The present invention is an orthography board game 8 preferably having an apiarian theme. Play consists of forming interlocking words on a honeycomb-style board 10 using hexagonally-shaped game tiles 12, such as shown in FIG. 1. Players compete for a high score by utilizing a variety of bonus spaces on the game board 10, avoiding penalty spaces, and rolling a set of game cubes or dice 14, as will be described in further detail below.

While the game tiles 12 such as shown in FIG. 1 are preferably hexagonally shaped, with a letter designation 16 placed on one of the two larger planer surfaces 18, those of ordinary skill in the art will recognize that the game tiles 12 are not limited to hexagonal configurations. For example, the game tiles 12 may be rounded or circular, sized to fit within a hexagonal space 20 on the game board 10. The only limitation to the game tile 12 configuration is determined by the size and configuration of the spaces 20 on the game board into which individual game tiles 12 is placed during play of the game 8.

The preferred frequency distribution of letter designations 16 among the game tiles 12 is shown in the following table:

| Total number of playing tiles = 101 |
|---|
| A = 7 in game |
| B = 3 in game |
| C = 2 in game |
| D = 3 in game |
| E = 11 in game |
| F = 2 in game |
| G = 3 in game |
| H = 2 in game |
| I = 7 in game |
| J = 2 in game |
| K = 2 in game |
| L = 4 in game |
| M = 2 in game |
| N = 5 in game |
| O = 7 in game |
| P = 2 in game |
| Q = 2 in game |
| R = 5 in game |
| S = 4 in game |
| T = 5 in game |
| U = 5 in game |
| V = 2 in game |
| W = 2 in game |
| X = 2 in game |
| Y = 2 in game |
| Z = 2 in game |
| "Free Bees" = 6 in game |

The letter frequency shown is selected to increase the variety of words formed during play of the game 8.

Figure 2:
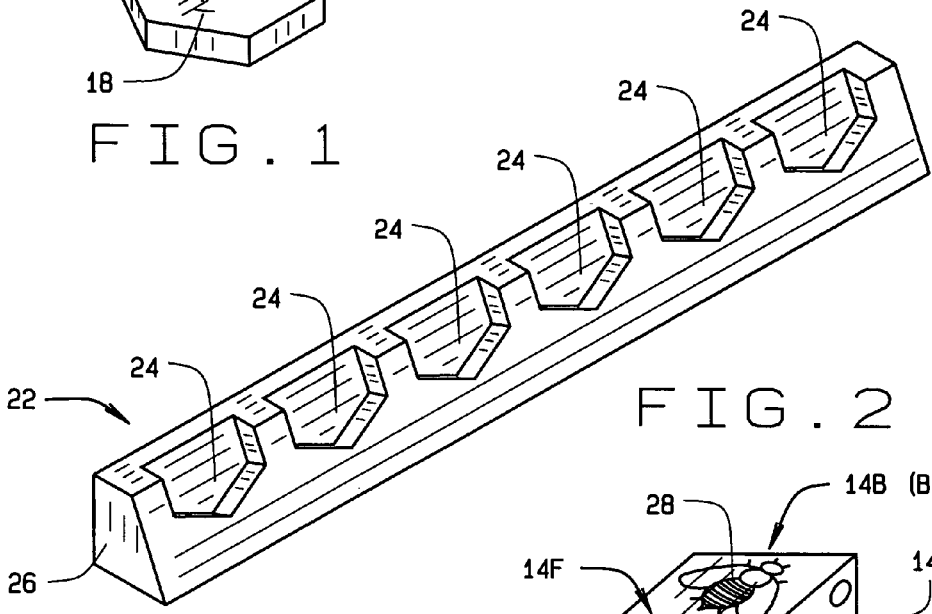
FIG. 2 is a perspective view of a tile rack of the present invention.

To facilitate organization of a players selection of game tiles 12 during play of the game 8, a letter rack 22 is optionally utilized. As shown in FIG. 2, the letter rack 22 consists of a plurality of spaced recessed portions 24 arranged along the length of a rack base 26. Each recessed portion 24 is configured to receive a single game tile 12, and orientated to hold the game tile 12 in an angled upright position for viewing by a player.

Figure 3:
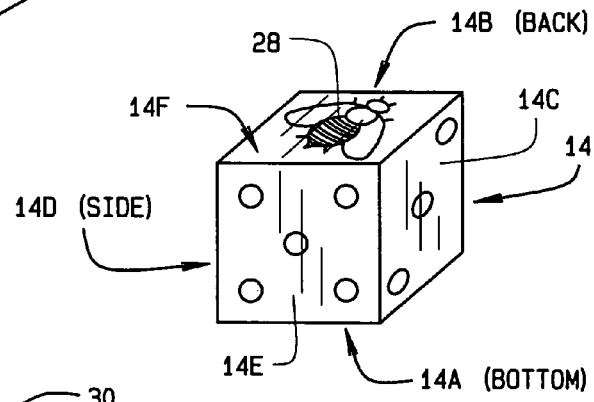
FIG. 3 is an perspective view of a game cube or dice of the present invention, illustrating a symbolic indicia.
Figure 4:
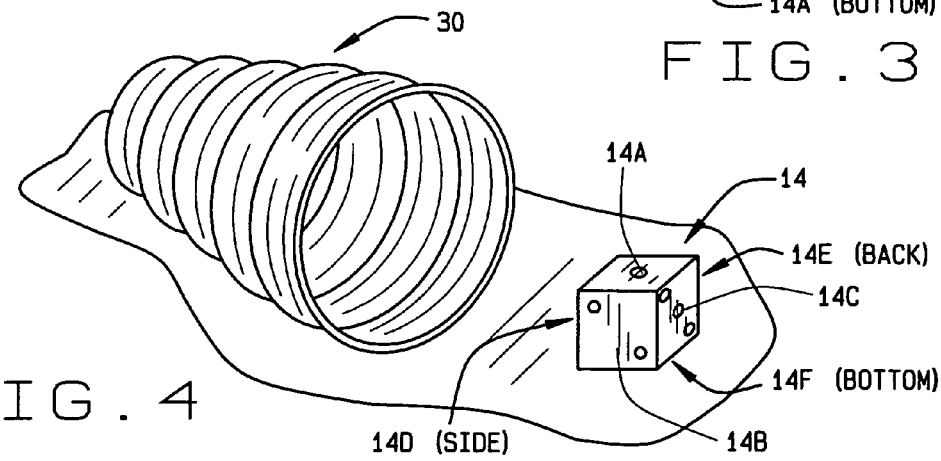
FIG. 4 is a perspective view of a dice rolling cup of the present invention.

A plurality of multi-faceted game scoring cubes or dice 14, preferably six total, are utilized during play of the game 8 to provide a base score for a player during each turn. Each game scoring cube or dice 14 is preferably but not limited to, a six-sided, defining a uniform cube. As shown in FIG. 3, five sides 14A–14E of the game scoring cube or dice 14 include traditional numerical designations corresponding to the numbers 1–5. At least one side of the dice 14, i.e. the sixth side 14F in the preferred embodiment, includes a symbolic representation of a honey-bee 28, consistent with the apiarian theme of the game 8. During play, a plurality of game scoring cubes or dice 14 are placed within a rolling cup 30. As illustrated in FIG. 4, the rolling cup 30 functions to provide a container within which the game scoring cubes or dice 14 may be shaken, to randomize the results as they are dispensed from the rolling cup 30. Preferably, the rolling cup 30 is formed in the shape of a bee hive, consistent with the apiarian theme of the game 8, however, those of ordinary skill in the art will recognize that the shape of the rolling cup 30 may be varied without changing the scope of the invention.

Figure 5:
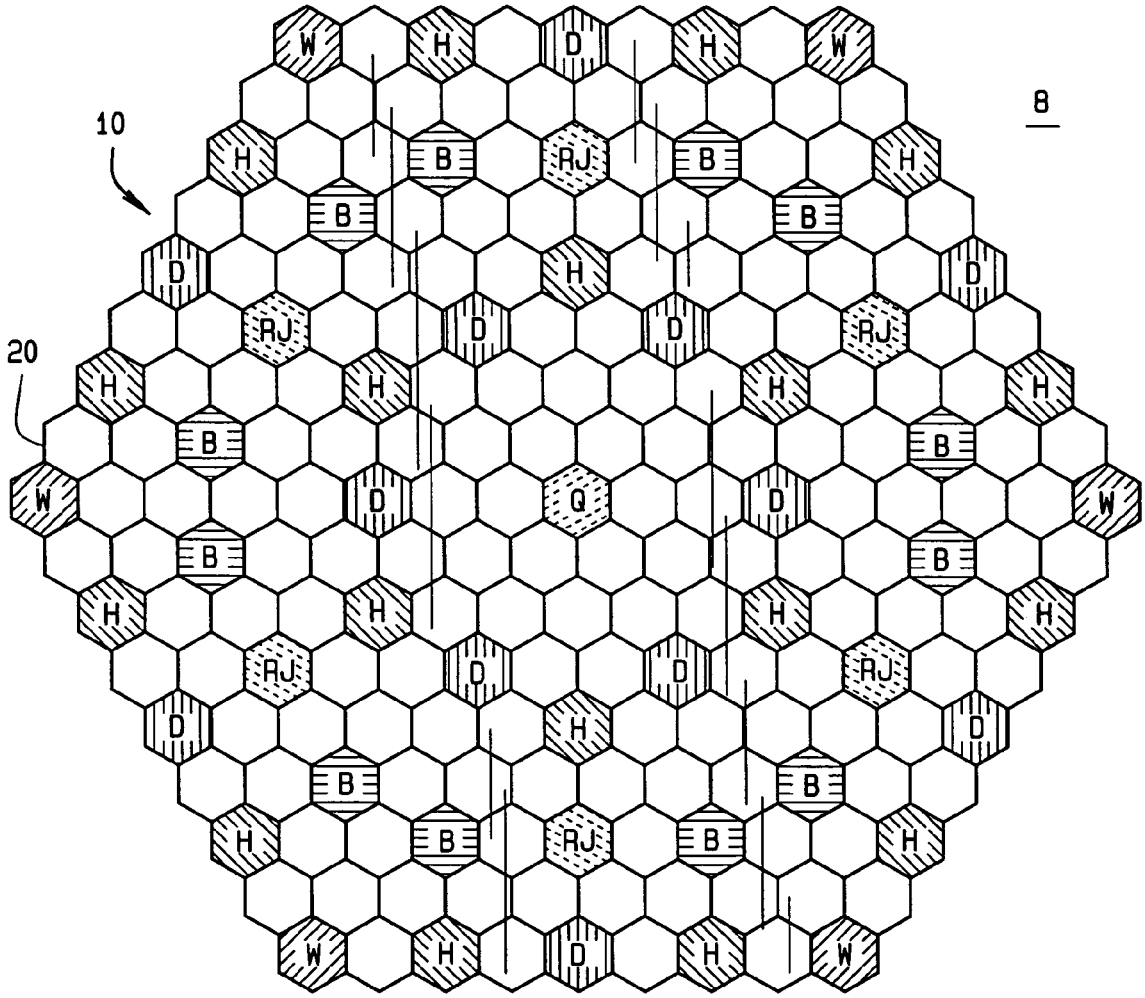
FIG. 5 is a plan view of the preferred game board of the present invention.

The preferred embodiment of the game board 10 of the present invention is shown in FIG. 5. Consistent with the apiarian theme of the game 8, the game board 10 is a combination of hexagonal spaces, cells, or chambers 20 arranged in an overall hexagonal layout. Preferably, there are seven different types of hexagonal spaces 20 disposed within the overall hexagonal layout, distinguished by color, indicia, or a combination thereof. The majority of hexagonal spaces 20 are "blank", and provide a player placing a game tile 12 thereon with no added benefit or penalty to a cumulative score. A first subset of hexagonal spaces 20 identified as "Q", "H", "B", and "W" are designated as "bonus" spaces, and provide a player placing a game tile 12 thereon with a bonus or benefit which increases the players cumulative score for that turn. Consistent with the apiarian theme of the game the "Q" space 20 corresponds to "Queen" and awards a player 10 bonus points, the "H" spaces 20 correspond to "Honey" and award a player 5 bonus points, the "B" spaces 20 correspond to "Brood" and award a player 2 bonus points, and the "W" spaces correspond to "Worker", and award a player a double score for that turn of play.

A second subset of spaces 20, identified as "D" are designated as "penalty" spaces", and reduce the score of a player placing a tile thereon. Consistent with the apiarian theme of the game, the "D" spaces 20 corresponds to "Drone" and reduces a players score by 5 points.

Finally, a third subset of spaces 20, identified as "RJ" provide options for a player which do not directly alter the players score, but which may modify the sequence of turn among a plurality of players. Consistent with the apiarian theme of the game, the "RJ" spaces 20 correspond to "Royal Jelly" and alter the play of the game, for example by requiring a player to roll the dice 14 again, or lose a turn. Those of ordinary skill in the art will recognize that the "bonus", "penalty" and "other" spaces are not limited to those variations described above. For example, additional "bonus" spaces may include extra points, or provide extra rolls of the game cube or dice 14. Similarly, additional "penalty" spaces may deduct extra points from a players score, while additional "other" spaces may provide for the addition or loss of multiple turns.

As shown in FIG. 5, the preferred embodiment of the present invention provides four types "bonus" spaces "Q", "H", "B", and "W", one type of "penalty" space, "D", and one type of "other" space, "RJ", arranged in a predetermined symmetrical pattern about the central space 20 of the game board 10. The predetermined symmetrical pattern is selected to encourage game play to branch outward from the direct radial pathways emanating from the central game space 20.

The preferred frequency distribution of spaces 20 on the board 10 is shown in the following table:

| Total number of playing spaces = 217 |
|---|
| Total number of bonus spaces = 37 |
| Spaces designated "Q" = 1; "H" = 18; "B" = 12; "W" = 6 |
| Total number of penalty spaces = 12 |
| Spaces designated "D" = 12 |
| Total number of other spaces = 6 |
| Spaces designated "RJ" = 6 |
| Total number of blank spaces = 162 |

Those of ordinary skill in the art will recognize that the number and placement of spaces 20 on the game board 10 of the present invention may be varied from the preferred embodiment described herein without deviating from the scope of the invention. For example, the play of the game 8 may be either lengthened or shortened by increasing or decreasing the number of spaces 20 on the board 10.

Figure 8:
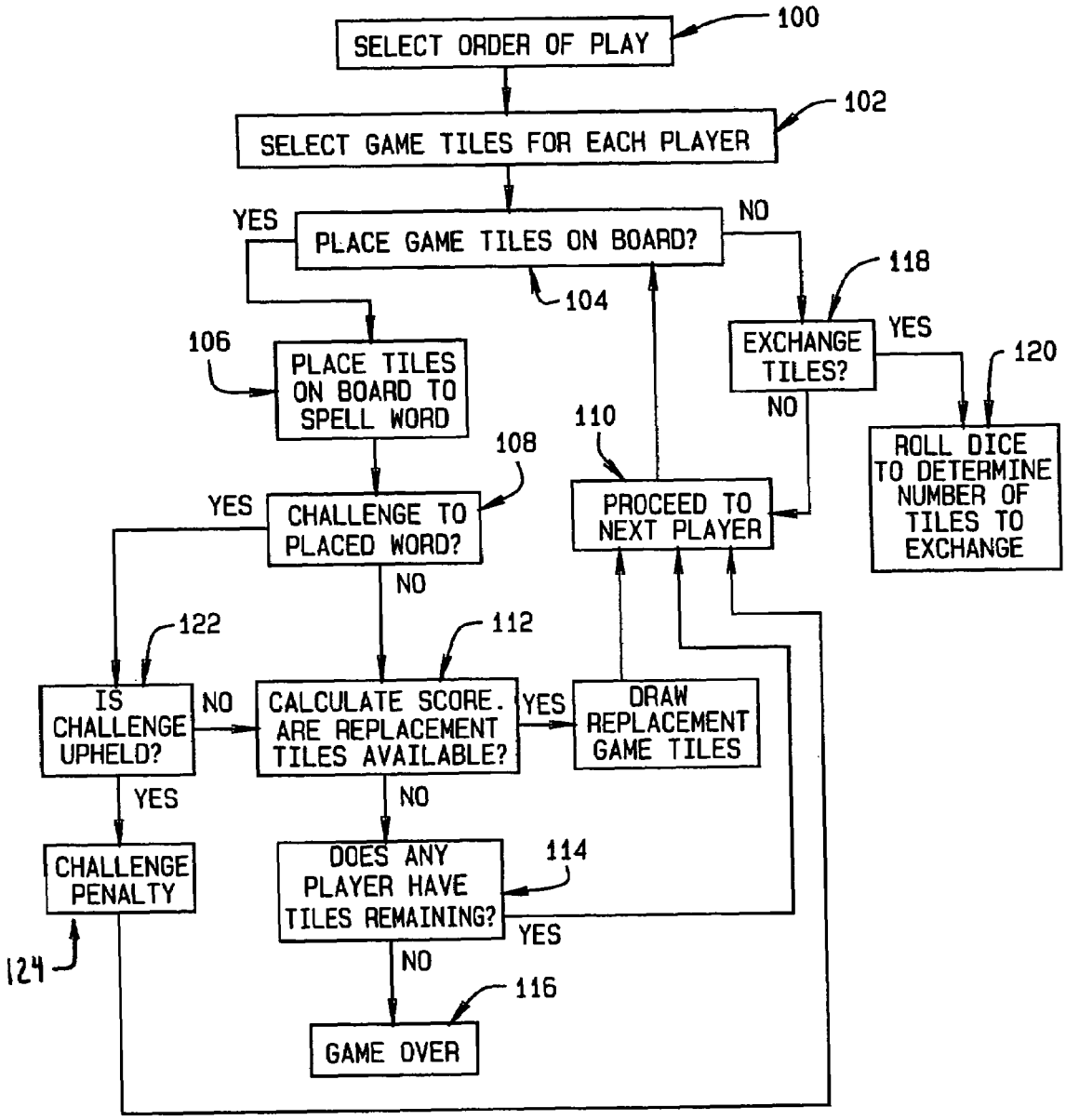
FIG. 8 is a flow chart illustrating the sequence of game play for the present invention.

A preferred method for playing the orthography game of the present invention is described as follows for two, three, or four players, preferably each over the age of six years. As shown in FIG. 8, to begin, each player rolls a dice 14 to select the order of play (Box 100). Either the first player to roll a symbolic representation of a honey-bee 28 goes first, or, if no player rolls a honey-bee 28, the player with the highest rolled value goes first. Each player then randomly selects a total of six game tiles 12 from a mixed set of the game tiles 12, starting with the first player (Box 102). Preferably, game tiles 12 are randomly selected from the mixed set one at a time, with each player taking a sequential turn. Alternatively, the each player may randomly select a total of six game tiles 12 in one turn.

Continuous play begins with the first player attempting to place sufficient game tiles 12 on the game board 10 to spell a word (Box 104). The first word played on the game board 10 must contain at least three letters. The first player announces the word to be played, and spells it aloud while placing the corresponding game tiles 12 on the game board 10, such that the letter indicia 16 on the game tiles 12 spells the word to be played (Box 106). For the initial play of the game, at least one game tile 12 of the first word played must be disposed within the center space 20 of the game board 10, designated as the queen space "Q".

Game tiles 12 can be arranged on the game board 10 in any linear direction corresponding to adjacent game spaces 20, but must be aligned along a straight line, i.e. a "bee line". Placement of words may be from left to right, right to left, top to bottom, or bottom to top, etc. Scoring in two different directions along the same line is not permitted, e.g., if a word such as "deer" or "not" is placed on the board, the player may not claim a score for the words "reed" or "ton" in addition to claiming a score for the words "deer" or "not".

Following the placement of the initial word on the game board 10, and there are not challenges to the placed word (Box 108), the player randomly draws additional game tiles 12 from a collection of available game tiles 12 to replace the number of game tiles 12 played during the turn, always maintaining the same number of game tiles 12 whenever possible. Towards the end of the game, the collection of available game tiles 12 may be diminished such that players are required to finish the game with fewer game tiles 12 than they started with.

Following selection of game tiles 12, play proceeds in sequence between the players (Box 110), with each player announcing a word and placing corresponding game tiles 12 on the game board 10. Play continues until the available game tiles 12 are exhausted (Box 112), and one player uses all of his or her remaining game tiles 12 (Box 114), at which point the play of the game 8 is stopped, and final scores tallied (Box 116).

During play, each new word placed on the game board 10 must incorporate at least one game tile 12 previously placed on the game board 10. Unlike conventional cross-word puzzles and board games such as Scrabble™, letter indicia 16 on game tiles 12 in game spaces 20 adjacent to the game spaces 20 in which game tiles 12 are placed to spell a word during a players turn are not required to spell additional words when taken in combination with the newly placed game tiles 12.

Figure 6A:
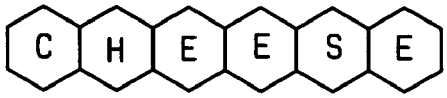
FIGS. 6A, 6B, and 6C illustrate the placement of game tiles to spell a variety of words.
Figure 6B:
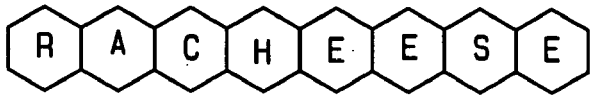
Figure 6C:
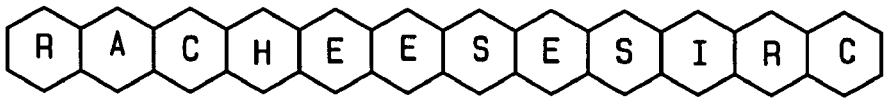
Figure 7:
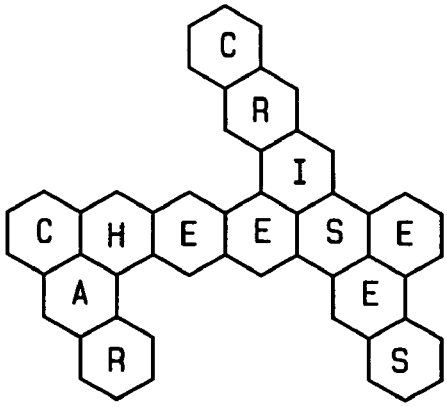
FIG. 7 illustrates an alternative placement of game tiles to spell the same words as shown in FIG. 6C.

One or more letters at either end of a word spelled out on the game board 10 by the placement of game tiles 12 may be utilized to start a subsequent word in any direction. For example, as shown in FIG. 6A, suitable game tiles 12 may be placed on the game board 10 in a straight line to form the word "CHEESE". In a subsequent turn, game tiles 12 having the indicia "A" and "R" may be added to the front of the previously placed word to spell the word "CAR" in reverse, as illustrated in FIG. 6B. Finally, game tiles 12 having the indicia "S", "I", "R", and "C" may be added to the end of the previously placed string of letters to spell the word "CRISES" in reverse, as illustrated in FIG. 6C. FIG. 7 illustrates alternate placements of game tiles 12 along different straight lines to spell the same words, "CAR", "CHEESE", and "CRISES".

Only one game tile 12 having a letter indicia 16 thereon may be placed in each game space 20 on the game board 10. Each game tile 12 must be placed within an available game space 20, and words must be fully contained within the boundaries of the game board 10 play area, as defined by the game spaces 20. Once a game tile 12 has been placed on the game board 10, it cannot be moved during the play of the game 8.

Game tiles 12 which are designated as "Free Bees" can be utilized by a player during a turn of play to substitute for any letter desired. The player must announce the letter for which the "Free Bee" is to be substituted, and the "Free Bee" game tile 12 cannot be changed from the substituted letter once it has been placed on the game board 10. Only one "Free Bee" game tile may be placed on the game board 10 by a player during a turn, however, a word may be formed with more than one "Free Bee" game tile 12 by utilizing "Free Bee" game tiles 12 previously placed on the game board 10 as substitutions for previously designated letters.

Preferably, a player may not utilize game tiles 12 to spell free standing prefixes, suffixes, proper nouns, hyphenated words, abbreviations, or contractions on the game board 10. All other words that can be found in any agreed upon standard dictionary are considered acceptable for play on the game board 10 if a player has the required game tiles 12.

A player who cannot place game tiles 12 on the game board 10 to form a word (Box 104) during his or her turn has the option to exchange some of his or her unplayed game tiles 12 (Box 118) and/or to pass the turn to the next player (Box 110). No game points may be scored by a player during a passed turn. To exchange unplayed game tiles 12, a player must roll a single game cube or dice 14 (Box 120). The roll of the game cube or dice 14 determines the number of game tiles 12 which the player may exchange for randomly selected game tiles 12. Game tiles 12 to be exchanged are returned to the collection of available game tiles 12 prior to the random selection of new game tiles 12. However, a roll of the symbolic representation of a honey-bee 28 indicates that the player has been "stung", and may not exchange any game tiles 12 on the present turn of play, and loses his or her next turn of play as well.

Once a word has been placed on the game board 10, any player may challenge the legitimacy of the word. A challenge, preferably referred to as a "Buzz-off Challenge" in keeping with the apiarian theme of the game, must be presented before scoring the word in question. To uphold the legitimacy of a word in question against a challenge, the word must be found in the previously agreed upon dictionary or other word reference guide (Box 122). If a word is found to be unacceptable, either by misspelling or non-compliance with the rules, the player must remove the game tiles 12 from the game board 10, lose a turn, and receive a score penalty (Box 124). If a word is found to be acceptable, the challenger loses a next upcoming turn, and receives a score penalty. After which, the player of the word in question proceeds to score the allowed points for placement of the game tiles 12 denoting the word, and proceed with the game play (Box 112).

Scoring of a players turn following placement of game tiles 12 on the game board 10 to form a word requires the player to roll a number of game cubes or dice 14 corresponding to the number of game tiles 12 which the player placed on the board 10 during the turn. The sum of the rolled dice 14 represents the players base score, with the indicia on each dice face 14 denoting a corresponding number of points, and with the symbolic representation of a honey-bee 28 denoting 10 points. A player utilizing all game tiles 12 during a turn receives a turn bonus, preferably 25 points. In the event each dice 14 rolled during scoring turns up the symbolic representation of a honey-bee 28, the player is considered to be "stung", and receives no points for the turn.

Placement of the game tiles 12 on the game board 10 during formation of a word affects the players final score for the associated turn. For each game tile 12 placed on a bonus space "Q", "H", or "B", the player receives a corresponding number of additional points, preferably 10 for a "Q" space, 5 for a "H" space, and 2 for a "B" space. If a player places a tile on a bonus space designated "W", the players total score for that turn is doubled. For each game tile 12 placed on a penalty space "D", the player receives a corresponding number of penalty points to be deducted from the score for the turn, preferably 5 points.

In the event that a player places game tiles 12 on the game board 10 in such a manner as to occupy both a "W" bonus space and a "D" penalty space in a single turn of play, the penalty deduction is taken first, and then the players score for the turn is doubled.

In the event that a player places game tiles 12 on the game board 10 in such a manner as to occupy both a "W" bonus space and a "H" bonus space in a single turn of play, the bonus points are added first, and then the players score for the turn is doubled.

In the event that a player places game tiles 12 on the game board 10 in such a manner as to occupy a "W" bonus space an "H" bonus space, and a "D" penalty space in a single turn of play, the bonus points and penalty deduction are negated, and the players remaining score for the turn is doubled.

Bonus points and penalty points are awarded for placing game tiles 12 on corresponding bonus or penalty spaces 20 on the game board 10 only once. No points are added or deducted for incorporating into new words the already placed game tiles 12 previously disposed on bonus or penalty spaces 20.

In the event that a player placed a game tile 12 on a designated "other" space 20, such as the "RJ" spaces disposed on the game board 10 during play, the play is preferably rewarded by being permitted a second roll of the same scoring dice 14 utilized to determine the players initial score for that turn, however, no bonus or penalty points are applied to the sum total of the second roll, which is subsequently added to the score obtained from the first roll of the scoring dice 14 to obtain the players total score for that turn.

Figure 9:
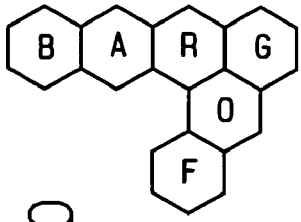
FIG. 9 is an illustration of game tile placement in which a connecting word is formed.

Those of ordinary skill in the art will recognize that the scoring rules for the game 8 of the present invention may be expanded to permit points to be accumulated for connecting words formed by the placement of the game tiles 12 on the game board 10 during a players turn. For example, as shown in FIG. 9, if a player places game tiles 12 having the indicia "F", "O", and "G" adjacent to previously played game tiles 12 which spell the word "BAR", the player may declare a total of three new words, "FOG", "GRAB", and "OR", and be granted three rolls of the scoring dice. One roll will utilize three scoring dice 14, two rolls will each utilize 1 scoring dice 14.

When game play ends (Box 116) with one player emptying all game tiles from a tile rack 22, and there being no replacement game tiles 12 available, each other player must roll a number of scoring dice 14 corresponding to the number of game tiles 12 remaining on their tile racks 22. The total sum of the scoring dice 14 rolled for each player is deducted from that players final score. The player with the highest overall score is declared the winner.

Those of ordinary skill in the art will recognize that various features of the game 8 may be changed without altering the core principles. For example, the game apiarian theme may be altered to another theme, and the game board 10 layout and game tile 12 shape correspondingly changed, provided that the game play and game scoring principles remain the same, i.e. the determination of a base score by a roll of one or more game cubes dice 14, and a modification of the base score utilizing predetermined characteristics of game spaces 20 upon which a player has placed game tiles 12 during play.

Those of ordinary skill in the art will recognize that the game 8 of the present invention may be modified for solitaire play or for play utilizing a computer either as a solitaire game, played against one or more computer opponents, or played against one or more human opponents who are either located in proximity to the computer or in communication therewith by means of a communication link such as the internet.

The present invention can be embodied in-part the form of computer-implemented processes and apparatuses for practicing those processes. The present invention can also be embodied in-part the form of computer program code containing instructions embodied in tangible media, such as floppy diskettes, CD-ROMs, hard drives, or an other computer readable storage medium, wherein, when the computer program code is loaded into, and executed by, an electronic device such as a computer, micro-processor or logic circuit, the device becomes an apparatus for practicing the invention.

The present invention can also be embodied in-part the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented in a general-purpose microprocessor, the computer program code segments configure the microprocessor to create specific logic circuits.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A method of playing an orthography board game on a game board, the game board comprising plurality of spaces, at least some of the spaces containing point altering indicia, the method comprising the steps of:

during a single round of play, (a) optionally, each player placing one or more game tiles on the spaces of said playing board to form one or more words;

(b) determining a base score for the formed word using a random number generator, such that the base score for the word formed is not based on the length of or letters used in the word so formed; and (c) modifying each determined base score in a predetermined manner based upon locations on said game board on which each corresponding player has placed said combination of game tiles to spell said one or more words;

upon completion of all rounds of play, providing a total score for each player consisting of the sum of each modified base score achieved during each round of play.

2. The method of playing an orthography board game of claim 1 wherein modifying a determined base score includes increasing said determined base score.

3. The method of playing an orthography board game of claim 1 wherein modifying a determined base score includes decreasing said determined base score.

4. The method of claim 1 wherein the number generator comprises one or more dice and the step of determining the base score comprises rolling said one or more dice and totaling the value of the dice so rolled.

5. A method of playing an orthography board game on a game board, the game board comprising a plurality of spaces, at least some of the spaces containing point altering indicia, the method comprising the steps of:

selecting a sequence of play among one or more players;

randomly selecting a predetermined number of game tiles for each of said one or more players from a collection of game tiles, each of said game tiles assigned a single letter or symbol having a predetermined frequency distribution with a set consisting of said collection of game tiles;

during a single round of play, (a) optionally, each player placing one or more of game tiles from said predetermined number of game tiles in said spaces of said game board to spell one or more words;

(b) determining a base score for the formed word using a random number generator, such that the base score for the word formed is not based on the length of or letters used in the word so formed; and (c) if any of the tiles of the word so formed lie on a space containing score modifying indicia, modifying the determined base score in accordance with the score modifying indicia upon which the played tiles lay, and adding said modified base score to a cumulative score for said player;

(d) for each player optionally placing said combination of game tiles on said playing board to spell one or more words, randomly selecting up to a corresponding number of game tiles from said remaining collection of game tiles to replenish said predetermined number of game tiles;

upon completion of all rounds of play, providing a total score for each player consisting of the sum of each modified base score achieved during each round of play.

6. The method of claim 5 for playing an orthography board game further including the steps of:

during said single round of play, (e) optionally, each player passing a turn of play to a subsequent player instead of placing a combination of game tiles from said predetermined number of game tiles on said playing board to spell one or more words.

7. The method of claim 5 for playing an orthography board game further including the steps of:

during said single round of play, (e) optionally, each player electing to attempt to replace one or more game tiles from said predetermined number of game tiles instead of placing a combination of game tiles from said predetermined number of game tiles on said playing board to spell one or more words.

8. The method of claim 5 for playing an orthography board game further including the step of optionally challenging said one or more words resulting from a player optionally placing said combination of game tiles on said playing board to spell one or more words, said step of challenging occurring prior to said rolling of said plurality of multi-faceted game scoring dice to determine said base score.

9. The method of claim 8 for playing an orthography board game further including, responsive to a successful challenge, the steps of returning game tiles placed on said game board corresponding to said one or more challenged words to said losing player's predetermined number of game tiles, decrementing said losing player's cumulative score, and skipping said losing player's next sequential turn in a round of play.

10. The method of claim 8 for playing an orthography board game further including, responsive to an unsuccessful challenge, decrementing a challenging player's cumulative score, and skipping said challenging player's next sequential turn in a round of play.

11. The method of claim 5 for playing an orthography board game wherein all rounds of play are completed when a player places all of said predetermined number of game tiles on said game board and no game tiles remain in said collection of game tiles.

12. A method of playing in an orthography board game, comprising the steps of:

selecting a sequence of play among one or more players;

randomly selecting a predetermined number of game tiles for each of said one or more players from a collection of game tiles, each of said game tiles assigned a single letter or symbol having a predetermined frequency distribution with a set consisting of said collection of game tiles;

during a single round of play, (a) optionally, each player placing a combination of game tiles from said predetermined number of game tiles on a playing board to spell one or more words;

(b) for each player optionally placing said combination of game tiles on said playing board in a linear manner to spell one or more words, rolling a plurality of multi-faceted game scoring dice to determine a base score; and (c) for each player optionally placing said combination of game tiles on said playing board to spell one or more words, modifying each determined base score in a predetermined manner based upon predetermined locations on said game board upon which each corresponding player has placed said combination of game tiles to spell said one or more words, and adding said modified base score to a cumulative score for said player;

(d) for each player optionally placing said combination of game tiles on said playing board to spell one or more words, randomly selecting up to a corresponding number of game tiles from said remaining collection of game tiles to replenish said predetermined number of game tiles;

(e) during said single round of play, optionally, each player electing to attempt to replace one or more game tiles from said predetermined number of game tiles instead of placing a combination of game tiles from said predetermined number of game tiles on said playing board to spell one or more words; said step of attempting to replace one or more game tiles includes rolling a single multi-faceted game scoring dice, said roll of said multi-faceted game scoring dice determining a number of game tiles to be replaced by randomly selected game tiles from said remaining collection of game tiles;

upon completion of all rounds of play, providing a total score for each player consisting of the sum of each modified base score achieved during each round of play.

* * * * *